US005448969A

United States Patent [19]

Stuart et al.

[11] Patent Number: 5,448,969

[45] Date of Patent: Sep. 12, 1995

[54] FLUIDIC BURNER

[75] Inventors: Kevin Stuart, Columbia; Ronald D. Stouffer, Silver Spring, both of Md.

[73] Assignee: Bowles Fluidics Corporation, Columbia, Md.

[21] Appl. No.: 216,522

[22] Filed: Mar. 23, 1994

[51] Int. Cl.[6] ..... F22B 5/00

[52] U.S. Cl. ..... 122/17; 122/24; 137/835; 431/2

[58] Field of Search ..... 431/1, 2; 122/17, 14, 122/24; 137/835

[56] References Cited

U.S. PATENT DOCUMENTS 5,129,585 7/1992 Bauer ..... 137/835 X
5,189,989 3/1993 Nilsson et al. ..... 122/24
5,335,644 8/1994 Katchka ..... 122/17 X

*Primary Examiner*—Denise L. Gromada
*Attorney, Agent, or Firm*—Jim Zegeer

[57] ABSTRACT

A gas burner comprising a gas manifold feeding an array of fluidic oscillators. Each fluidic oscillator has a power nozzle connected to the gas manifold and an outlet for issuing a sweeping jet of gas to ambient. Each fluidic oscillator is spaced a predetermined distance from its neighboring fluidic oscillators and a baffle plate controls air flow to the sweeping jet of gas from each fluidic oscillator.

23 Claims, 5 Drawing Sheets

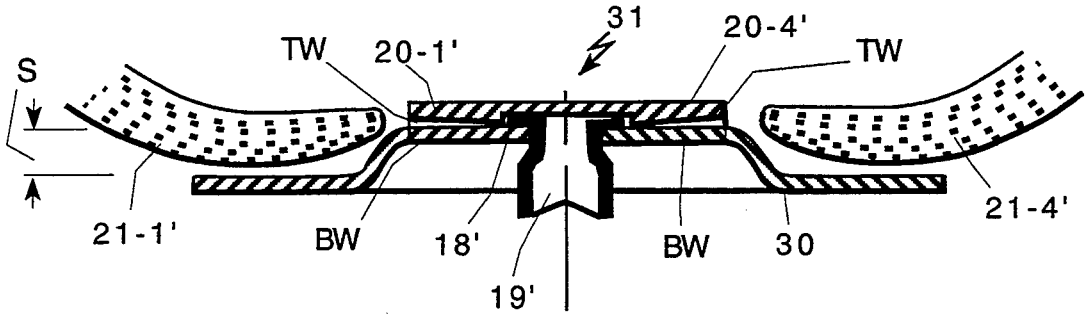
FIG. 4
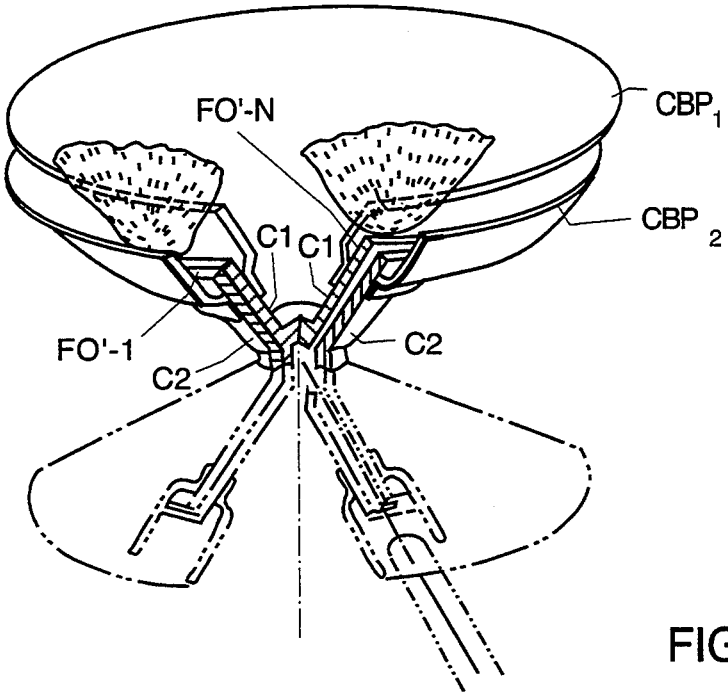
FIG. 7A
FIG. 7B
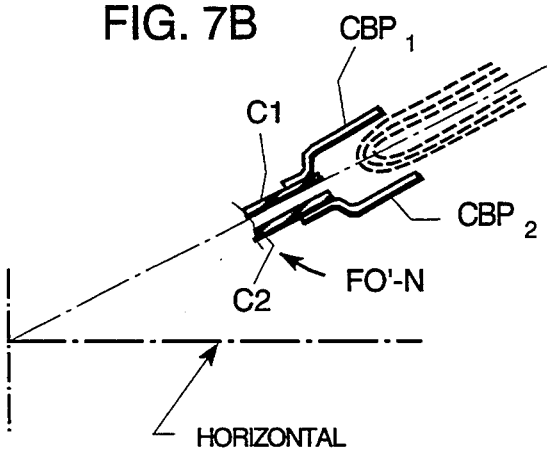

FLUIDIC BURNER

REFERENCE TO RELATED APPLICATIONS

This application is related to Stouffer application Ser. No. 08/050,385, filed May 12, 1993, entitled "BURNER METHOD AND APPARATUS" now U.S. Pat. No. 5,383,781.

BACKGROUND AND BRIEF DESCRIPTION OF THE INVENTION

The application of fluidic nozzles to gas appliance burners gives advantages over conventional burners, but before these advantages can be discussed, the operation of a conventional gas burner will be explained in detail.

Conventional natural gas burners used in appliances require a precision hole or spud in the gas supply line to the burner to meter or control the flow of gas to the burner. The metered gas must then be mixed with air, commonly referred to as primary air, prior to entering the burner port section. This operation is called premixing and requires a mixing chamber. This premixing chamber is usually a venturi and is designed to provide a gas/primary air mixture of about 30 to 50% of the stoichiometric ratio for the gas fuel. This premixed gas/air flow enters a port section of the burner where it is distributed out of a series of burner holes, mixes with the remaining amount of air necessary to create a stoichiometric mixture (secondary air) and is ignited. The burner ports are sized and distributed to reduce the escaping air/gas mixture velocity to match the flame propagation velocity. This will stabilize the flame and prevent both lift-off and reduce the formation of a poor burning yellow flame. The ports in a conventional burner are also sized to self extinguish a flame once the supply of gas is stopped. Both of these requirements place restrictions on conventional burner port size and their distribution in the burner. These restrictions usually limit the heat rate in BTU/hour that can be sustained per burner port area. The heat rate per burner port area is referred to as "port loading" and is typically 10,000 to 20,000 BTU/hr*in$^2$. With careful control of primary air to prevent yellow and flashback, the port loading can be increased to about 50,000 BTU/hr*in$^2$. Above 50,000 BTU/hr*in$^2$ the control of the primary air becomes very critical.

On the other hand, as disclosed in the above Stouffer application and in Stouffer U.S. Pat. No. 5,149,263, a fluidic element burner uses a fluidic oscillator circuit to cause the gas jet to sweep back and forth in a manner that promotes the mixing of the gas stream and the ambient air. This oscillating mixing process continues until a stoichiometric mixture is obtained and a stable burning blue flame can be sustained. The oscillating mixing action obtained from a fluidic element also allows the burner to be designed and manufactured without a venturi or other premixing chamber. By eliminating The premixing chamber, significant cost and space savings can be achieved as compared to conventional burners.

Eliminating the need for a premixing chamber creates other advantages for the fluidic element burner as compared to the conventional burner. To effect the proper gas/air premix in the venturi, the conventional burner must use the velocity of the gas jet leaving the spud to entrain the primary air and drive the mixture through the burner ports. If an air/gas ratio of 10:1 is required to obtain a stoichiometric mixture, a 3:1 to 5:1 primary air/gas ratio is needed out of the venturi section of the burner. This also represents a 300 to 500% increase in the volumetric flow as compared to the flow of the gas fuel alone. This increased volumetric flow must be handled by the burner ports and leads to the burner port loading mentioned above. Since the fluidic element burner does not require the use of a premix chamber, it does not lose the jet velocity experienced by a conventional burner in the venturi nor does it have to handle the larger volumetric flow prior to ignition. The fluidic burners can therefore operate at port loadings significantly higher than conventional burners. Port loadings above 2,250,000 BTU/hr*in$^2$ can be obtained in fluidic element burners.

By avoiding the premixing chamber, the fluidic element burner also avoids the gas supply jet pressure drop experienced in the premix area of a conventional burner. The gas exiting the fluidic element burner has a higher velocity than the premixed fuel exiting a conventional burner.

The higher velocity sweeping jet sets up a series of gas wave fronts that is mixed with ambient air to form a stoichiometric mixture prior to burning. As the gas wave fronts move outward from the fluidic outlet, ambient air is drawn around and into the wave of fuel. The ambient air also draws some exhaust gasses into the mixing action. This mixing of exhaust gases into the burner air supply is called "vitiated" flow and is a well known method of reducing the NOx emissions in burners. The fluidic element burner, however, creates this vitiated flow pattern automatically without requiring costly re-circulation vanes or other techniques requiring blowers and ducts.

Diffusion flames typically seen in conventional burners, have inner and outer cones (see FIG. 1). The fluidic element burner, however, produces a flame with a wrinkled surface and has a highly turbulent base. This characteristic flame is stable further away from the burner head than is achievable with a conventional diffusion flame. The greater distance between the flame and the burner allows the fluidic element head to operate at a lower temperature and therefore manufactured from lower cost material.

Compared to a conventional burner diffusion flame, the wrinkled flame surface caused by the oscillating gas jet also means the flame has a larger surface area per unit volume. This results in a efficient, faster burning flame that resists the formation of prompt NOx emissions.

The descriptions and explanations presented above illustrate how the simple replacement of a conventional atmospheric blue flame burner with a fluidic element blue flame burner will result in a smaller, simpler and less expensive burner. The descriptions also show that the higher velocity oscillating gas jet inherent and unique to the fluidic element burner also begin to incorporate emission reduction techniques.

The basic object of the present invention is to provide an improved gas burner. Another object of the present invention is to incorporate the features of a fluidic element burner in reduced emissions gas burners. A further objective of the invention is to provide an improved gas burner for water heaters.

A detailed discussion of what emissions are important and how they are formed will be helpful in understanding the invention..

In the combustion chamber of a natural gas appliance, air and gas are combined to a greater than stoichiometric mixture and then ignited. Some amount of excess air is necessary because perfect mixing is not achievable in the appliance environment. The results of this combustion process are illustrated in the following equation where the natural gas is represented as methane and air is represented by only $N_2$ and $O_2$.

$$CH_4+N_2+O_2=N_2+CO_2+CO+HC+O_2+H_2O+NO+NO_2+HEAT$$

Most of the atmospheric nitrogen ($N_2$) passes through the combustion process without reacting. Carbon dioxide ($CO_2$), oxygen ($O_2$) and water ($H_2O$) are harmless byproducts of the combustion process while heat is tile desirable objective of the burning process. There should be a minimum amount of unburned hydrocarbons (HC) in a properly designed and maintained combustion chamber so the remaining components of the combustion process are CO, NO and $NO_2$. Nitrogen oxides (NO and $NO_2$) and carbon monoxide are the emission components that are regulated for environmental and safety reasons, respectively. Nationally, CO regulations have been in place for years with a limit set at about 400 ppm ($CO_2$ normalized air free). Conventional gas appliances typically meet the required CO levels with little difficulty, but recent environmental concerns have focused in on NOx (NO plus $NO_2$) emissions from burners.

The nitrogen oxides formed are nitric oxide (NO) and nitrogen dioxide ($NO_2$). Of these two, NO is the primary compound formed during combustion in gas appliances. There are three mechanisms for the production of NO: fuel derived, prompt, and thermal.

Fuel NO is formed with organic nitrogen compound present in the fuel gas are oxidized. Since natural gas is free of such compounds, fuel NO is not a concern for emission control.

Prompt NO is formed early in the combustion reaction when hydrocarbon radicals react with atmospheric nitrogen. The following equation illustrates this reaction process.

$$N+OH=>NO+H$$

This typically occurs in flame fronts where fuel rich mixtures are present. Prevention of fuel rich regions through good mixing can minimize the tendency to form prompt NO.

The primary contributor to total NOx emissions in gas burners is thermal NO. Thermal NO is formed when diatomic oxygen and nitrogen are decomposed into oxygen and nitrogen atoms at high temperature. These atoms then combine to form NO as described by the following reactions:

$$O+N_2=>NO+N \text{ and } O_2+N=>NO+O$$

NO emission levels can be controlled by limiting flame temperature, minimizing residence time of combustion products at high temperatures and limiting the available $O_2$. NO reaction rates are strongly temperature dependent. Cooling of the flame can dramatically lower reaction rate as shown in the table below:

| Flame Temperature (deg F.) | Thermal NO Formation rate (ppm/sec) |
|---|---|
| 2800 | 10 |

-continued

| Flame Temperature (deg F.) | Thermal NO Formation rate (ppm/sec) |
|---|---|
| 2400 | 0.1 |
| 2000 | 0.001 |
| 1800 | 0.00001 |

Limiting the time that combustion products spend at these temperatures can also minimize NO formation rates. NO reactions occur much slower than other reactions, so changing the residence time does not normally affect CO or other emissions. There is, however, a limit to the rate and amount of cooling that can be done. Rapid cooling or quenching of the flame can cause unacceptably high CO or hydrocarbon levels.

Since the rate of thermal NO formation is proportional to the square root of the oxygen concentration, limiting or staging the available oxygen can be an effective NO control strategy. Again, care must be exercised, as lowering the oxygen level will increase flame temperatures, thus increasing NO formation rates. Very low oxygen levels will also increase CO emissions.

Nitrogen dioxide ($NO_2$) is typically formed by the oxidation of NO. This occurs in cooler regions of the flame. The most common process to form $NO_2$is:

$$NO+HO_2z,=>NO_2+OH$$

The $HO_2$ is formed from hydrocarbon radicals and molecular oxygen. Limiting the NO formation will obviously limit the $NO_2$ levels as well. In most appliances where excess air is kept low, the $NO_2$/NOx ratio is on the order of 0.1. In cases where high excess air levels are present, such as on gas cook tops, this ratio may be as high as 0.75.

As described previously, Carbon monoxide (CO) emissions can be greatly affected by NOx reduction methods. Rapid cooling of combustion products by impingement on surfaces below 1300 deg F. or rapid addition of excess air can increase CO levels. Other causes of high CO emissions are deficient combustion air and poor mixing.

From this brief discussion, it is obvious that the primary focus of emission control in gas fired appliances is to control the formation of NO. Since the excellent mixing of a fluidic element nozzle inherently inhibits the formation of prompt NO, the emission control opportunity primarily centers on controlling the formation of thermal NO.

The first method used to reduce thermal NO emissions of a gas flame is to reduce the overall flame temperature. This can be accomplished by allowing the flame to impinge on a material that can absorb or conduct the heat away from the flame. The material used to conduct the heat away is usually referred to as an "insert". The insert can be a solid or porous material and is constructed of a material that can withstand the peak and normal operating temperature it will experience in the combustion chamber. Experiments using a single fluidic element Brass burner nozzle and firing it vertically into a 4" by 4" expanded metal insert (see FIG. 2). The insert was positioned in the flame at heights that varied from ⅜" to 2.25" above the nozzle. The emissions measurements showed that the NOx readings were reduced by about 43% from the NOx readings taken without the insert. The flame shape remained oval and about the same size as observed without the insert.

The addition of a non-porous insert to a fluidic water heater burner also showed significant improvement in the NOx emissions. A fluidic element water heater burner has an average NOx readings of 120 ppm ($CO_2$ normalized air free). With a flame insert added to the burner, the NOx readings are reduced about 29% to an average of 93.1 ppm, while the CO reading increased only 36 ppm to 98.1 ppm. Again, the primary NOx reduction mechanism in this case is the lowering of the flame temperature through conduction and radiation heat transfer through the metal insert. Care must be taken to design the insert properly to conduct and radiate the heat away from the flame fast enough to reduce the formation of thermal NOx but not too fast to cause a major increase in the formation of excessive amounts of CO.

The cost impact of using this method to reduce the NOx emission in a gas burner is determined by the material that must be utilized in the flame insert. For temperatures below 1200 deg F., inexpensive low carbon steel can be used. For temperatures between 1200 and 1600 deg. F., stainless steels are usually required and for temperatures between 1600 and 2000 deg F., a high temperature nickel steel is required. Above 2000 deg F., a ceramic material must be used. As the operating temperature goes up so does the cost of the materials used to manufacture the insert and can go over $1 per square inch for ceramic materials.

A new and unique method of controlling NOx according to the invention incorporates a plate mounted under the fluidic gas burner. The plate is referred to herein as a "baffle" and reduced the NOx measurement in the fluidic element water heater burner by 47% to 63 ppm. By using various sizes and locations or spacings below the burner plate it was found that the baffle plate could be tailored to meet the flame distribution requirements for the appliance combustion chamber while reducing the formation of NOx emissions.

The baffle inhibits the formation of NOx in three ways. The first way is limited quenching of the flame temperature due to the close proximity of the relatively cold baffle plate. The flame is not being quenched as much as with the flame insert because the baffle plate temperature remains relatively cold compared to the temperature observed in the flame insert. The baffle temperature measured from 500 to 950 deg F. while insert temperatures have been observed about 2000 deg F. Although flame cooling has an effect on the formation of NOx, it is not considered to be the primary contributor of the reduction of NOx in the baffled fluidic element gas burner.

The second way the baffle inhibits the formation of NOx is by causing the recirculation of exhaust gases. The recirculated exhaust gases add to the vitiated flow already inherent in the fluidic element nozzle and further reduce the formation of NOx emissions. The fact that this process exists and effects the NOx formation was demonstrated by adding a plate above a baffled water heater burner to interrupt the exhaust gas recirculation and the NOx increased by 10 ppm.

The third and most significant way the baffle inhibits the formation of NOx emissions in a fluidic element burner is by altering the mixing of the air at the base of the flame. The baffle restricts the amount of oxygen available at the base of the flame and limits the formation of prompt NOx. The peak flame temperatures are also reduced and decrease the rate at which thermal NOx is formed.

Since the fluidic element burner also avoids the pressure drop associated with the premix chamber of a conventional burner, the gas jet exiting the fluidic element has a fairly high velocity and projects the flame further away from the burner head. As the flame extends beyond the edge of the baffle plate, additional oxygen is mixed with the flame to complete the combustion reaction and inhibit the formation of CO emissions.

From this comparison of the technological advantages of a fluidic element burner, it is apparent that the fluidic element burner can be made much smaller and requires fewer parts than a conventional gas burner. The fluidic element burner also has advantages in the inherent way it incorporates a NOx reducing vitiate flow to mixing of ambient air and the gas fuel jet. By taking further advantage of the mixing and higher velocity gas jet in the fluidic element burner, baffles and inserts can be used to reduce the flame temperature and modify the oxygen content in the combustion process to further reduce the NOx emissions from a gas burner. All these advantages yield a smaller, simpler, lower cost burner with lower emissions than is available from a conventional gas burner.

BRIEF DESCRIPTION OF THE DRAWINGS

The above and other objects, advantages and features of the invention will become more apparent when considered with the following specification and accompanying drawings wherein:

FIG. 4 illustrates a NOx limiting baffle plate mounted under an array of fluidic gas burners incorporating the invention.

DETAILED DESCRIPTION OF THE INVENTION

Figure 1:
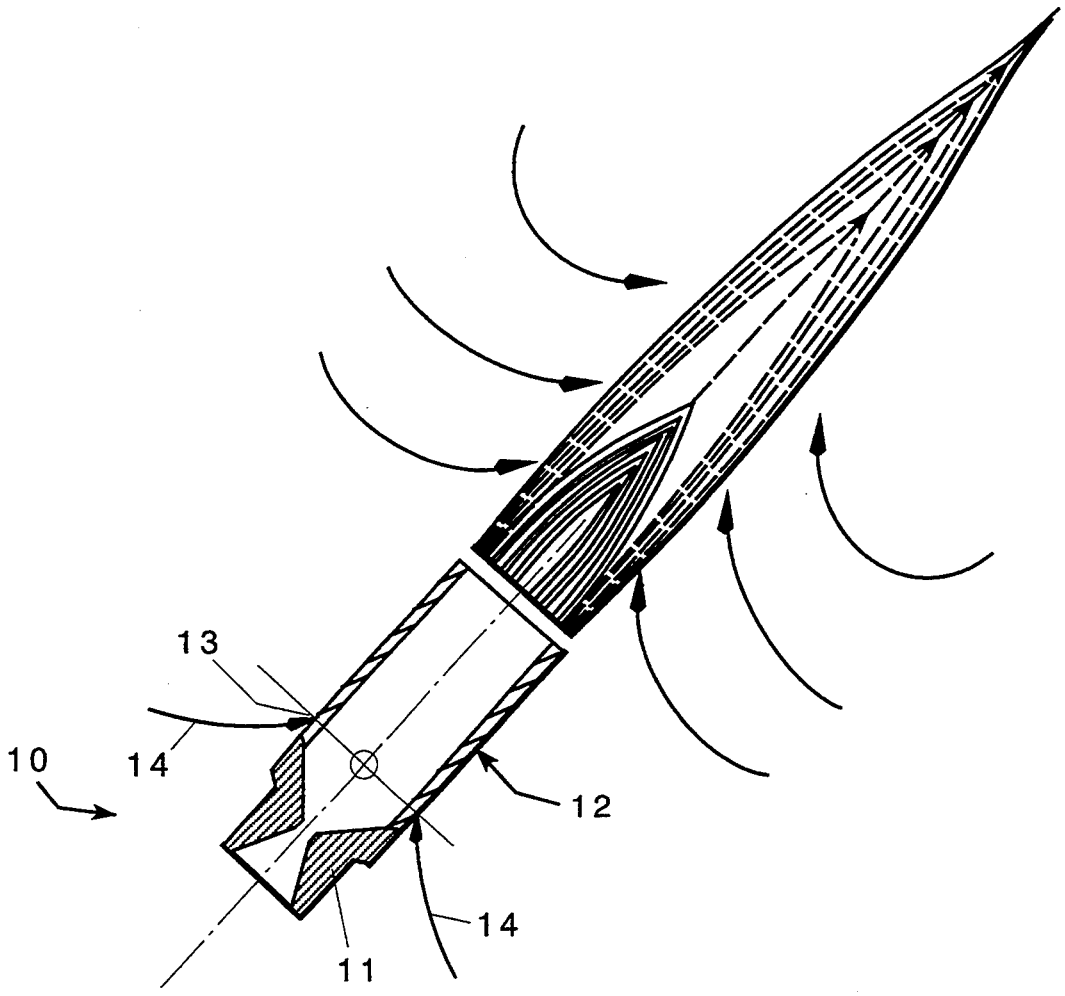
FIG. 1 (PRIOR ART)
FIG. 1 illustrates a diffusion flame produced by conventional prior art burner.

As described earlier, FIG. 1 illustrates a conventional burner 10 having a inlet nozzle 11, for injecting air into a mixing chamber 12 which has a plurality of air inlet apertures 13 to allow air, indicated by the arrows 14, to be drawn in for mixing with the gas to form a premixed mixture which is then ignited and has the flame characteristics described earlier.

Figure 2:
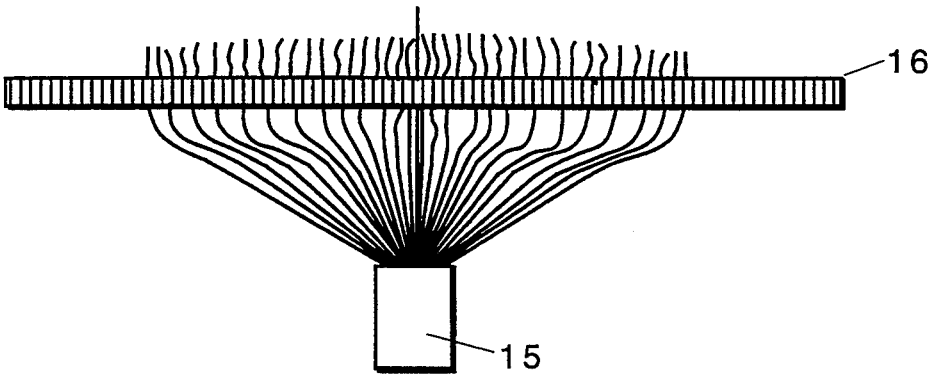
FIG. 2 illustrates a fluidic oscillator firing into an expanded metal insert for reducing NOx emissions.

In FIG. 2, a fluidic nozzle 15 oscillates the jet of gas in a fan pattern which, in FIG. 2 is in the plane of the paper so that the mixing of the gas is outside of the nozzle per se, and the flame occurs downstream or at a distance spaced from the nozzle. A perforated NOx insert plate 16 is positioned in the flame at heights that vary from $\frac{3}{8}''$ to $2\text{-}\frac{1}{4}''$ above the nozzle. The emissions measured were greatly reduced.

Figure 3:
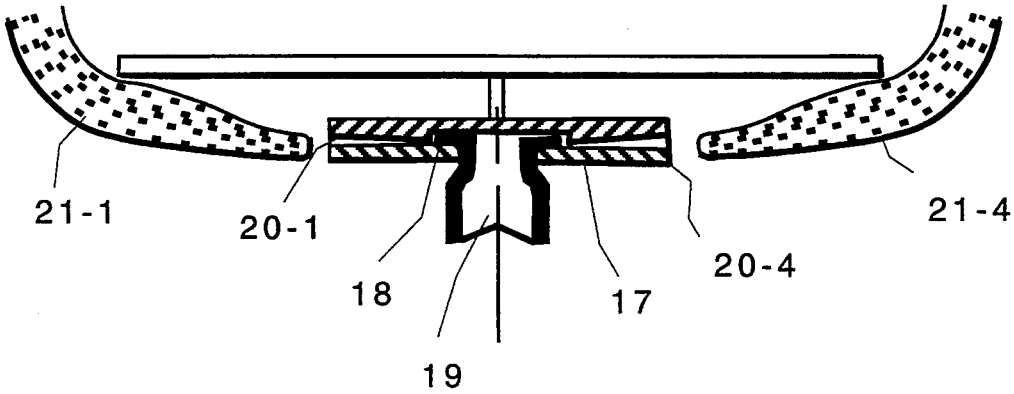
FIG. 3 is a gas burner having a horizontal array of fluidic oscillators and a non-porous insert positioned above the array of fluidic oscillators.

In the embodiment shown in FIG. 3, an array of fluidic oscillators 17 (shown in plan view in FIG. 6) are each coupled to a gas manifold 18 which is supplied from a common gas supply 19. Each oscillator 20-1, 20-2, 20-3, 20-4 and 20-5 (there being five in this embodiment and only two in the sectional view, but it will be appreciated that more or less fluidic oscillators may be included in an array and, it is clear that the oscillators need not be coplanar but, for construction purposes, this is the preferred embodiment) issue a jet of gas which is oscillated or swept for mixing with air and initially ignited by a pilot light, for example, (shown in FIG. 6). The issuing gas jet is mixed with air to form a stoichiometric mixture which produces a flame as diagrammatically illustrated in FIG. 3. In this case, a nonporous insert provides significant improvement in NOx emissions, as described earlier herein. In both cases, the NOx emissions is by virtue of the mechanism of lowering the flame temperature through conduction and radiation heat transfer through the metal insert. Inserts have been designed out of ceramic materials, as well as metal, so both-types can be used.

Figure 5:
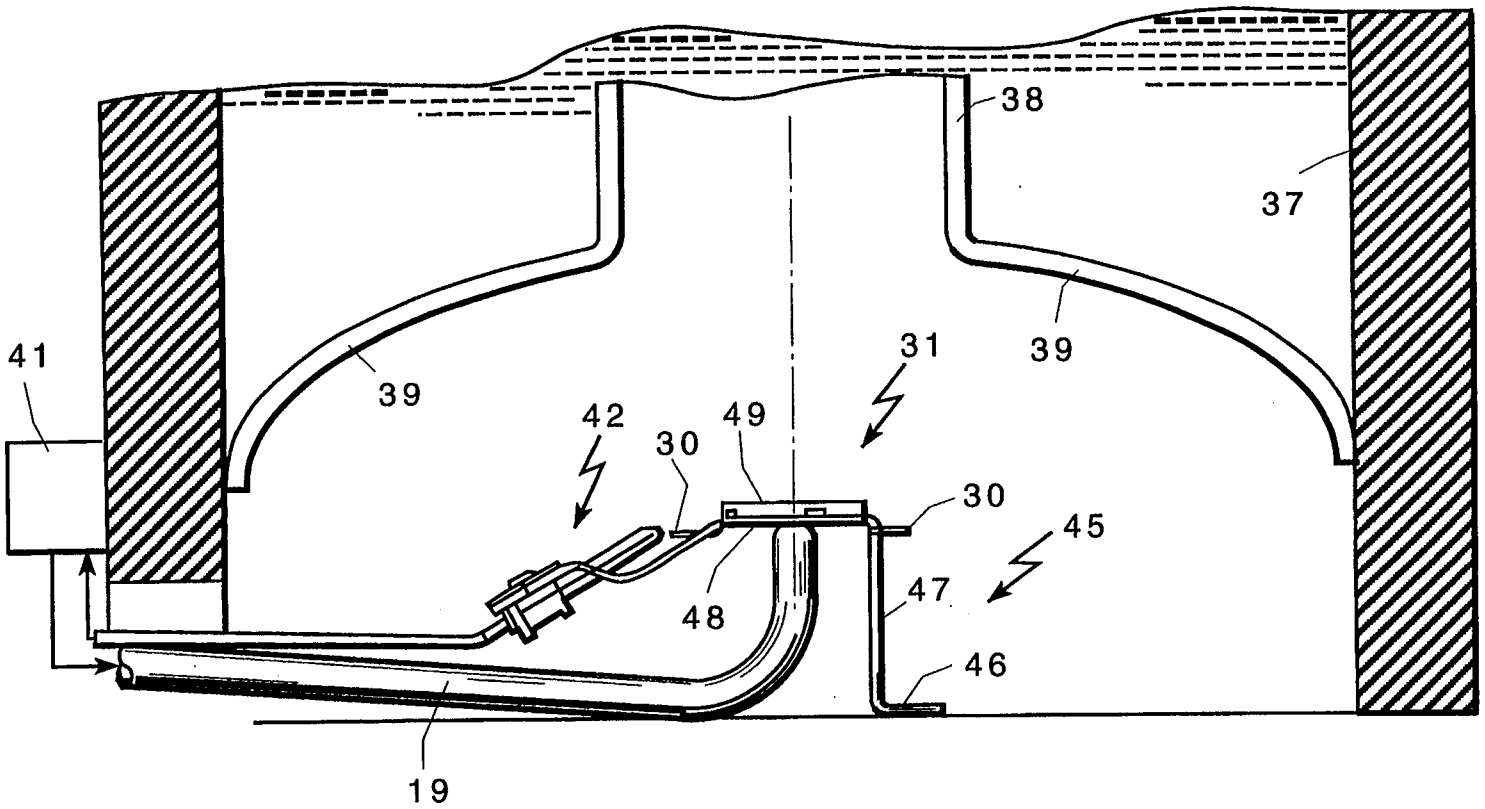
FIG. 5 is a sectional view of a preferred embodiment of the invention as applied to a gas-fueled hot water heater.
Figure 6:
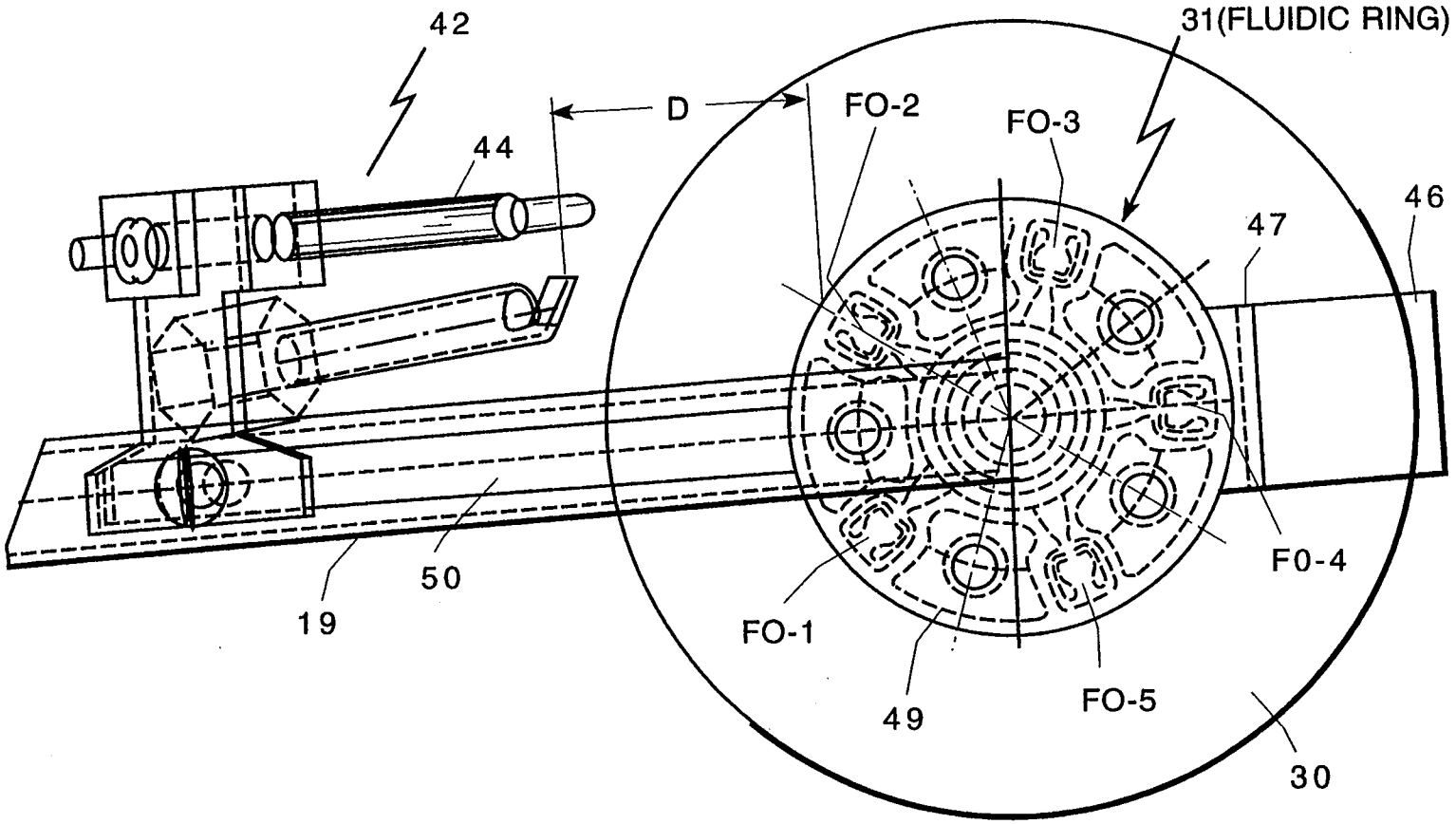
FIG. 6 is a top plan view of the gas hot water heater showing the relation of the gas burner pilot light and thermocouple sub-assembly, FIG. *7a* is a cut-away perspective view of a fluidic gas burner incorporating the invention, and FIG. *7b* is a sectional view of one fluidic element thereof.

Referring now to FIGS. 4, 5 and 6, a major feature of the invention resides in the incorporation of a baffle plate 30 which is mounted below the fluidic gas burner. In this embodiment, the baffle plate 30 is about ¼" inch below the bottom surface walls of the fluidic oscillator. As shown in FIG. 4, the top wall TW diverges or tapers away from the bottom wall BW to provide a wider fan angle for a given specific firing rate. The baffle plate 30 reduces NOx measurements significantly and, by using various sizes and locations or spacings below the burner plate, the baffle plate can be tailored to meet the flame distribution requirements for most appliance combustion chambers while reducing the formation of NOx emissions. As described earlier, the baffle plate 30 reduces NOx emissions by limited quenching of the flame temperature due to the close proximity of the relatively cold baffle plate. Secondly, the NOx baffle inhibits the formation of NOx by causing the recirculation of exhaust gases. Thirdly, the most significant way the baffle inhibits the formation of NOx emissions is by altering the mixing of the air at the base of the flame.

While the baffle plate 30 is illustrated as circular and flat or planar in FIG. 6, it will be appreciated that it need not be circular and it need not be formed flat or as the back or closure plate for the fluidic oscillators. They can be conical as shown in FIG. 7. Except for the fluidic oscillator array 49 and baffle 30, shown in FIG. 5, the water heater shown in FIG. 5 is conventional. It includes a tank 35 surrounded by foam or other form of insulation 36, and a ceramically coated tank lining 37. A flue 38 for carrying off spent gases in a dome-shaped heat transfer chamber 39. It will be appreciated that there is a large amount of heat transfer from the flue 38 to water stored in the tank. While this configuration of hot water heater is illustrated, it will be appreciated that the invention is applicable to all forms of gas hot water heaters.

As illustrated in FIGS. 5 and 6, a conventional pilot light and thermocouple assembly 42 are coupled to a gas control unit and temperature controller 41, which are likewise conventional. The pilot light is maintained on constantly and serves to ignite the gas issuing from the fluidic array 31. A thermocouple or other flame sensor senses the pilot light and, if the pilot goes out, it shuts off all gas flow from controller 41.

As shown in FIGS. 5 and 6, a metal support bracket 45 having a lower leg 46 for securement to the floor structure of the hot water heater, an upstanding vertical pedestal portion 47, a horizontal plate member 48 to which the member 49 carrying the array of fluidic oscillators is spot welded so that the plate 48 serves as a cover or plate sealing-off the fluidic oscillators, the baffle plate 30 which may be integrally formed with the mounting bracket 45, and an extension arm 50 carrying the pilot burner and thermal couple sensor sub-assembly 42. In FIG. 6, each fluidic oscillator FO1, FO2, FO3, FO4, FO5 is of the type having a uniform pattern in which there is no dwell at the end of each sweep of the jet of gas, as disclosed in Stouffer U.S. Pat. No. 4,508,267. Preferably, the oscillators are not synchronized. Each fluidic oscillator has a top and bottom wall T and B as shown in FIG. 4, which taper or diverge away from each other for the purpose of providing a wider fan angle for a specific firing rate.

In the embodiment shown in FIGS. 7*a* and 7*b*, the burner is comprised of an array of fluidic oscillators FO-1, FO-2 . . . FO-N, each having the oscillator silhouette shown in FIG. 6, formed between two conical surfaces $C_1$, $C_2$ and supplied from a common gas supply CGS. The conical surfaces $C_1$, $C_2$ are at an angle to the horizontal. A pair of conical baffle plates $CBP_1$ and $CBP_2$ control the flow of ambient air to be mixed with the oscillating or sweeping gas jets issuing from each fluidic oscillator FO'-1 . . . FO'-N.

The range of application of the invention is wide, ranging from domestic uses such as in water heaters (residential and commercial), central heating furnaces, gas boiler, wall furnaces (vented, residential), room heaters (vented and unvented), ranges/ovens, dryers, to industrial uses such as industrial burners, dryers, heat and steam generators drying and finishing reactors, curing ovens, etc.

While there has been shown and described preferred embodiments of the invention, it will be appreciated that various other embodiments and modifications and adaptations of the invention will be readily apparent to those skilled in the art and it is intended that such obvious modification, adaptations and variations be encompassed within the claims appended hereto.

What is claimed is:

1. A gas burner comprising a gas manifold, an array of fluidic oscillators, each fluidic oscillator having a power nozzle connected to said gas manifold and an outlet for issuing a sweeping jet of gas to ambient, each said fluidic oscillator being spaced a predetermined distance from its neighboring fluidic oscillators and a baffle plate means for controlling air flow to said sweeping jet of gas from each fluidic oscillator.

2. The invention defined in claim 1 wherein said fluidic oscillators and said baffle plate means have a common central axis, and each fluidic oscillator has a longitudinal axis extending along a radial line from said common axis.

3. The invention defined in claim 1 wherein said fluidic oscillators are substantially coplanar.

4. The invention defined in claim 1 or claim 2 or claim 3 wherein at least one of said fluidic oscillators is of the type in which there is substantially no dwell at the end of each sweep of said jet of gas.

5. The invention defined in claim 1 or claim 2 or claim 3 wherein said fluidic oscillators have a uniform pattern.

6. The invention defined in claim 1 or claim 2 or claim 3 wherein said fluidic oscillator has silhouettes which are formed in a common body and have a common cover plate therefor.

7. The invention defined in claim 1 wherein said fluidic oscillators are not synchronized.

8. The invention defined in claim 1 or claim 2 or claim 3 wherein said fluidic oscillators and said baffle plate member have a common central axis wherein said fluidic oscillator and said baffle plate member are in a conical pattern defined by revolution of a line about said central axis.

9. The invention defined in claim 1 or claim 2 or claim 3 wherein said fluidic oscillator has an oscillation chamber with top and bottom walls which diverge from each other in the direction from said power nozzle to said outlet.

10. A water heater having a heat exchanger having one or more passages for the flow of water and a gas burner as defined claim 1 or claim 2 or claim 3 for heating said heat exchanger.

11. In a water heater having a heat exchanger having one or more passages for the flow of water in heat exchange relation to a gas burner, the improvement wherein said gas burner is comprised of a gas manifold, an array of fluidic oscillators, each fluidic oscillator having a power nozzle connected to said gas manifold and an outlet for issuing a sweeping jet of gas, each said fluidic oscillator being spaced from its neighboring fluidic oscillator so that the sweeping jet of gas issuing from each fluidic oscillator is spaced a predetermined distance from its neighboring fluidic oscillators.

12. The invention defined in claim 11 wherein said fluidic oscillators are substantially coplanar.

13. The invention defined in claim 11 or claim 12 wherein at least one of said fluidic oscillators is of the type in which there is substantially no dwell at the ends of each sweep of said gas jet.

14. The invention defined in claim 11 or claim 12 wherein said fluidic oscillators have a uniform pattern.

15. The invention defined in claim 11 or claim 12 wherein said fluidic oscillator has silhouettes which are formed in a common body and have a common cover plate therefor.

16. The invention defined in claim 11 or claim 12 wherein said fluidic oscillators are not synchronized.

17. The invention defined in claim 11 or claim 12 wherein said fluidic oscillators have a common central axis wherein said fluidic oscillations are in a conical pattern defined by revolution of a line about said central axis.

18. The invention defined in claim 11 or claim 12 wherein said fluidic oscillator has an oscillation chamber with top and bottom walls which diverge from each other in the direction from said power nozzle to said outlet.

19. The invention defined in any one of claims 11 or 12 including a baffle plate means for controlling air flow to said sweeping jet of gas and reduce NOx emissions.

20. In a gas burner having a no moving part fluidic oscillator for issuing a sweeping jet of gas to a gas burning area spaced from said fluidic oscillator, a method of reducing Nox emissions from gas burning in said gas burning area comprising positioning a baffle plate on one side of said sweeping jet of gas for controlling air flow to said sweeping jet of gas.

21. A gas burner comprising a fluidic oscillator having a gas inlet for coupling to a source of gas and having an outlet for issuing a sweeping gas jet for mixing with ambient air and burning of mixed gas and air at a burn region spaced from said outlet, the improvement comprising a NOx insert in said burn region for lowering the flame temperature of burning gas in said burn region.

22. The gas burner defined in claim 21 wherein said NOx insert is a perforated plate.

23. The gas burner defined in claim 21 wherein said NOx insert is a non-perforated plate member.

* * * * *